US005797651A

United States Patent [19]

Christa

[11] Patent Number: 5,797,651

[45] Date of Patent: Aug. 25, 1998

[54] SOFA WITH REVERSIBLE UPHOLSTERY

[75] Inventor: Carol Christa, Duluth, Ga.

[73] Assignee: England/Corsair, Inc., New Tazewell, Tenn.

[21] Appl. No.: 731,221

[22] Filed: Oct. 15, 1996

[51] Int. Cl.[6] ..... B68G 5/00

[52] U.S. Cl. ..... 297/283.1; 297/219.1; 297/228.13; 297/283.3; 5/630; 5/633

[58] Field of Search ..... 297/219.1, 228.13, 297/283.1, 283.3; 5/633, 630

[56] References Cited

U.S. PATENT DOCUMENTS

| | | | |
|---|---|---|---|
| 1,116,041 | 11/1914 | Durant | 297/228.13 |
| 1,695,101 | 12/1928 | Hoffman | 297/283.3 |
| 2,663,878 | 12/1953 | Backus | 5/630 X |

*Primary Examiner*—Peter M. Cuomo
*Assistant Examiner*—Rodney B. White
*Attorney, Agent, or Firm*—Rhodes Coates & Bennett, L.L.P.

[57] ABSTRACT

A seat has a frame, including a bench and a back, padded upholstery including a particular fabric pattern on the frame covering the bench and the back with a pocket in the upholstery in a forward-facing lower portion of the back as it covers the back, a cushion symmetrical about a centerline and having first and second sides and sized to fit in the pocket in the upholstery to fill the pocket and having first and second differing upholstery fabrics on the first and second sides, respectively, and complementary retainers on the cushion and in the pocket cooperative with one another including loops and clasps for a lower portion of the cushion and male and female snap portions for an upper portion of the cushion to retain the cushion in the pocket in a first orientation showing the first upholstery fabric and a second orientation showing the second upholstery fabric, wherein the first upholstery fabric is also the particular fabric pattern and the second upholstery fabric is different from the particular fabric pattern.

19 Claims, 5 Drawing Sheets

SOFA WITH REVERSIBLE UPHOLSTERY

BACKGROUND OF THE INVENTION

The present invention relates to an improvement in upholstered furniture providing for reversible cushion components in what otherwise appears to be a permanent furniture piece.

Modern upholstered furniture includes numerous visually-articulable cushions. A modern fashion trend is to provide the cushions in differing or contrasting fabrics, including leathers, or leathers and fabrics, for a collage-type appearance.

The present invention provides enhancements to conventional upholstered furniture designs to aid in the flexibility of such designs to permit the consumer, retailer or manufacturer to readily change the appearance of the design without requiring reupholstering.

SUMMARY OF THE INVENTION

The present invention fulfills this need in the art by providing a seat including a frame, including a bench and a back. Padded upholstery on the frame covers the bench and the back, and forms a pocket in the upholstery as it covers the back. A cushion having first and second sides and sized to fit in the pocket in the upholstery to fill the pocket has first and second differing upholstery fabrics on the first and second sides, respectively. Complementary retainers on the cushion and in the pocket are cooperative with one another to retain the cushion in the pocket in a first orientation showing the first upholstery fabric on the cushion and a second orientation showing the second upholstery fabric.

In a preferred embodiment the pocket is in a forward-facing lower portion of the back. The seat may be a sofa, loveseat, chair or other upholstered furniture item.

The complementary retainers may include loops and clasps. Preferably the complementary retainers also include male and female snap portions. The loops and clasps are positioned for a lower portion of the cushion, and the male and female snap portions are located for an upper portion of the cushion.

In a preferred embodiment the padded upholstery includes a particular fabric pattern and the first upholstery fabric is also the particular fabric pattern. Typically, the second upholstery fabric is different from the particular fabric pattern. Also, the first and second patterns may be different than the particular fabric pattern.

The cushion may be symmetrical about a centerline.

The invention also provides a method of altering the look of a seat including the steps of providing a seat including a bench and a back with padded upholstery covering the bench and the back with a pocket in the upholstery as it covers the back, a cushion having first and second sides and sized to fit in the pocket in the upholstery to fill the pocket and having first and second differing upholstery fabrics on the first and second sides, respectively, inserting the cushion in the pocket in a first orientation showing the first upholstery fabric on the cushion, removing the cushion from the pocket and inserting the cushion in the pocket in a second orientation showing the second upholstery fabric.

The inserting steps may include inserting the cushion in the pocket in a forward-facing lower portion of the back. The inserting steps may each include engaging loops and clasps to secure the cushion in the pocket. They may also include engaging male and female snap portions to secure the cushion in the pocket.

Preferably, one of the inserting steps includes inserting the cushion to expose a fabric on the cushion that is the same as the fabric on the rest of the seat. Typically the other inserting step includes inserting the cushion to expose a fabric on the cushion that is different from the fabric on the rest of the seat. The second inserting step may include rotating the cushion about a centerline to obtain the second orientation to expose the second fabric.

BRIEF DESCRIPTION OF THE DRAWINGS

The invention will be better understood after a reading of the Detailed Description of the Preferred Embodiments and a review of the drawings in which.

DETAILED DESCRIPTION OF THE PREFERRED EMBODIMENTS

Figure 1:
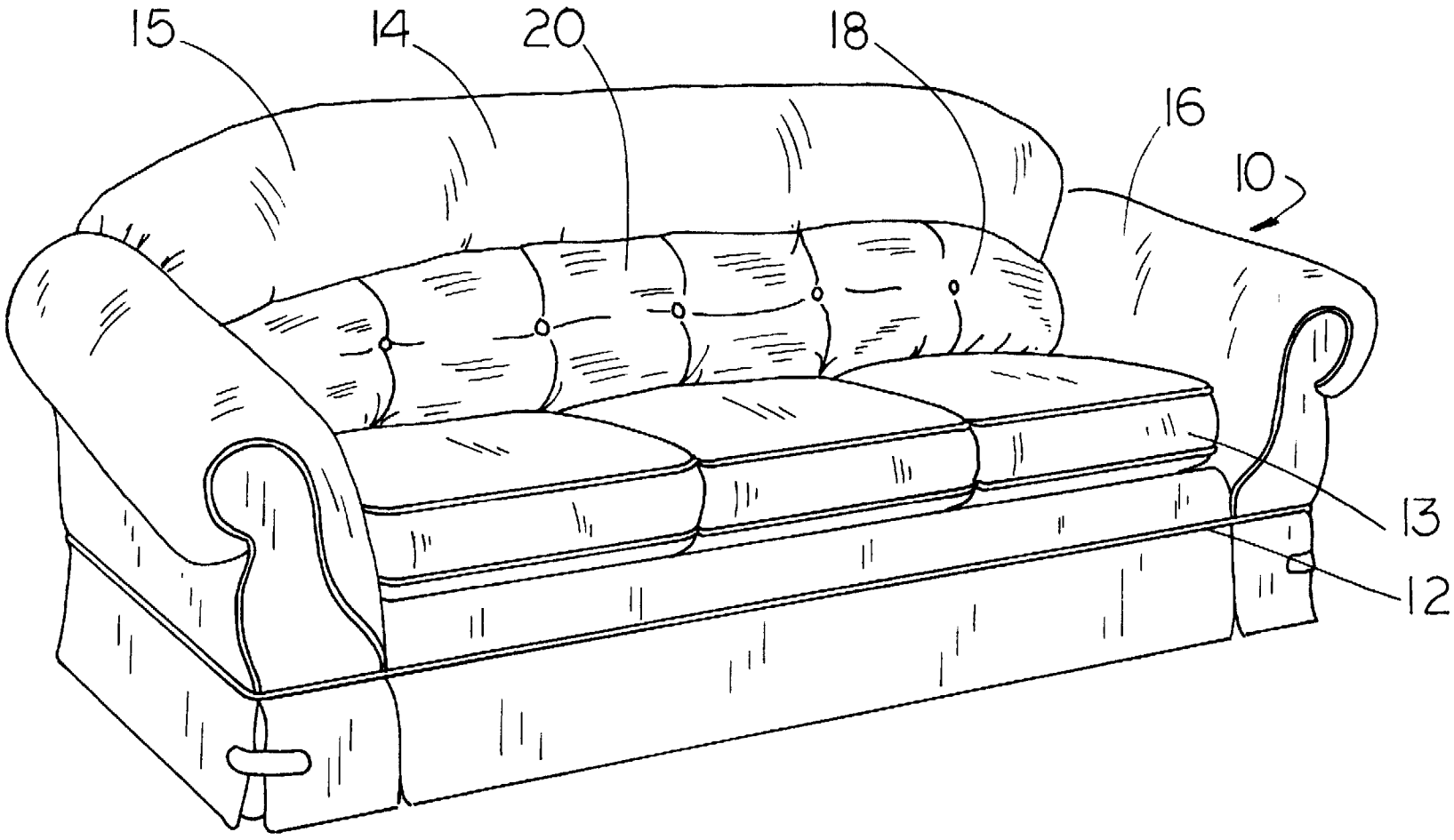
FIG. 1 is perspective view of a sofa embodiment of the invention, cushion installed.

As seen in FIG. 1, a sofa 10 is depicted. The invention is capable of being carried out in numerous embodiments, including loveseats and chairs. Any upholstered furniture item in which there are visually-articulable cushions may be a candidate for modification in accordance with the invention.

The sofa 10 is provided with a bench portion 12 with conventional seat cushions 13. Note that the cushions 13 may be held in place with conventional clasps and hooks. The sofa 12 is also provided with upholstered arms 16 and a back 14. Back 14 has an upper permanent padded upholstery roll 15. As seen in FIG. 1, the lower portion of the back 14 has a cushion 18 provided with a fabric 20. In the embodiment as shown in FIG. 1, the fabric 20 is a contrasting or otherwise differing fabric from the fabric shown on the remainder of the sofa 10. This provides advantageous design flexibility. However, it maybe desired to further enhance that design flexibility by causing the cushion 18 to have a fabric appearance other than fabric 20. Other portions of the sofa 12 may be modified according to the concepts of this invention.

Figure 2:
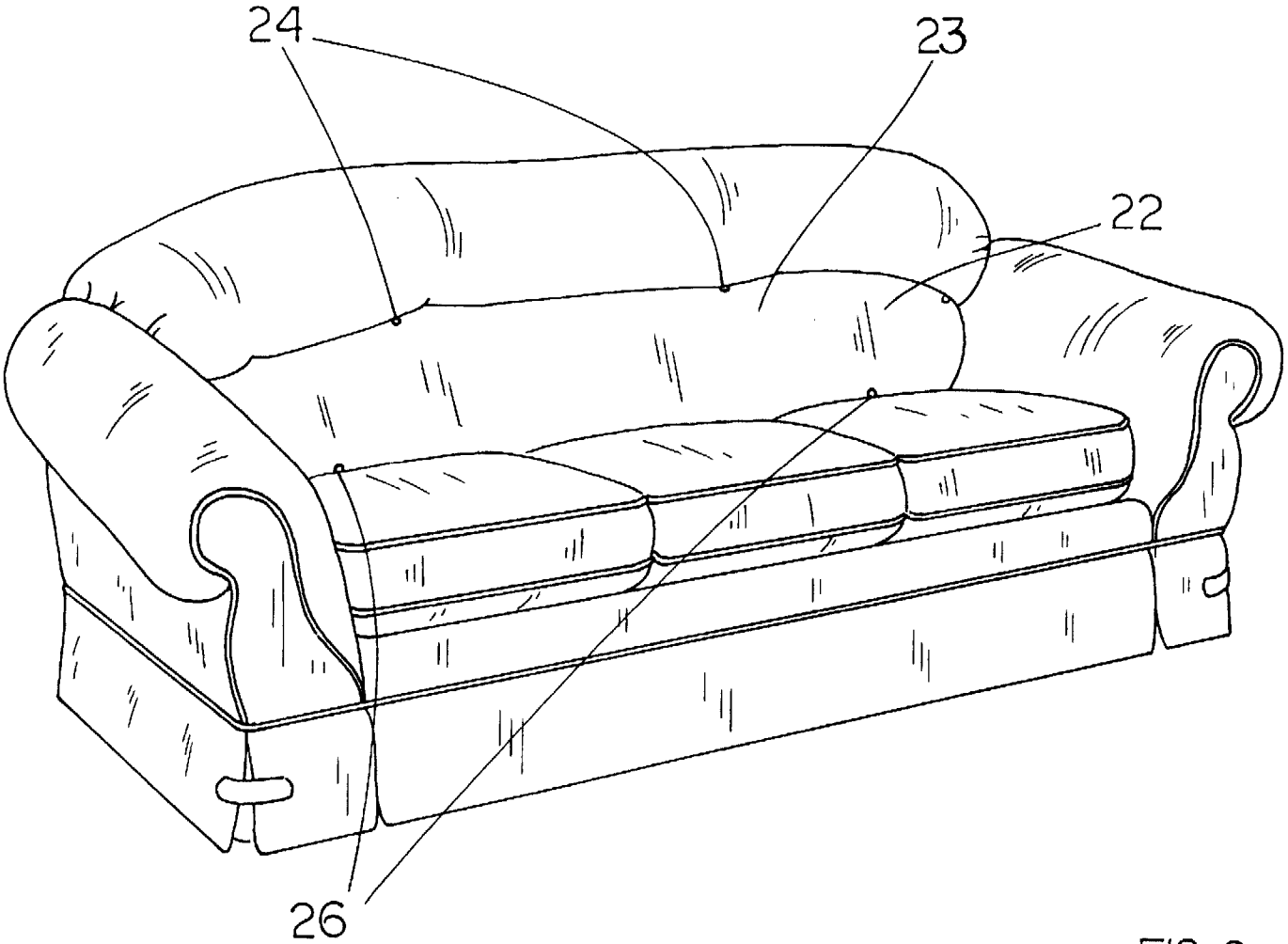
FIG. 2 is a perspective view of a sofa embodiment of the invention, cushion removed.

As shown in FIG. 2, the cushion 18 has been removed from the sofa 12, showing a pocket 22. The pocket 22 is formed as a cavity in the back 14 of the sofa. As will be appreciated, the bench 12, arms 16 and back 14 cover a frame, not visible due to the padded upholstery of the sofa. The padded upholstery is provided in the form of springs and/or batting covered by fabric, as is conventional design.

As seen in FIG. 2, the pocket 22 is provided with a fabric covering 23. Fabric 23 is usually not visible and therefore may be an inexpensive, functional, durable or otherwise unadorned fabric. Clasps 26 are secured to the fabric 23 by fabric loops and male snap members 24 are secured directly to the fabric 23. The cushion 18 seen in FIG. 1 has been held in place by engagement of respective female snaps on the cushion 18 and loops engaged by the clasps 26. Since the clasps can be opened for loop removal and the snaps disengaged, the cushion 18 is readily removable from the pocket 22, resulting in the conditions seen in FIG. 2.

Figure 3:
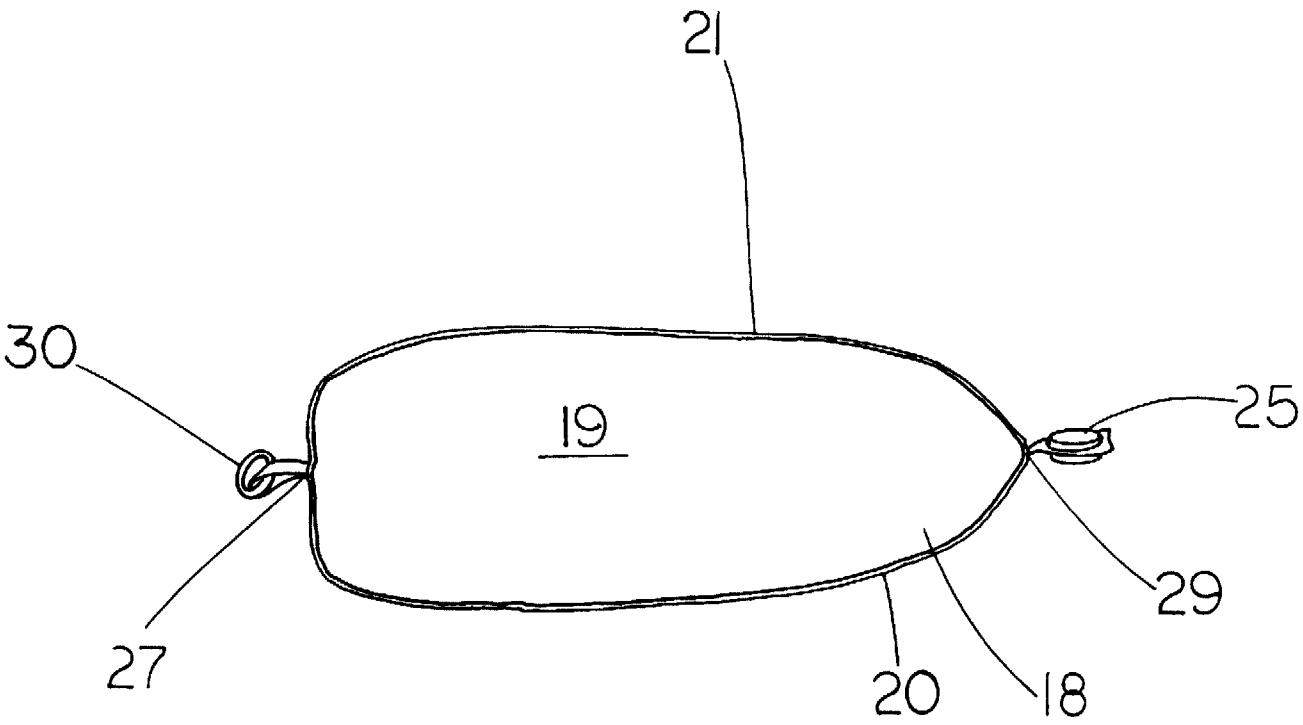
FIG. 3 is a sectional view of the cushion.

The cushion seen in sectional view in FIG. 3 is provided with conventional batting 19, covered on one side with the fabric 20 and on the backside with a differing fabric 21. Fabric 21 matches the other fabric on the sofa 12, but it is not required. Indeed, both fabric 20 and fabric 21 can be different from the fabric on the other portions of the sofa 12. The fabrics 20, 21 meet at seams 27, 29. Disposed on the top seam 29 is the female snap member 25. Attached to the bottom seam 27 is a fabric loop receiving a metal ring loop 30. The loops, clasps, and male and female complementary retaining members are presently preferred embodiments, but other retaining means can be used including hook and loop (i.e., Velcro) and various other known securing arrangements. In some cases, a cushion may have a snug enough fit in its pocket that retaining means are not required. As can be appreciated, the snap 25 and ring 30 are hidden from view in the assembled sofa in FIG. 1. The ring 30 is obscured by the seat cushion 13 and the male and female snaps are hidden under the top roll 15 of the back.

Figure 4:
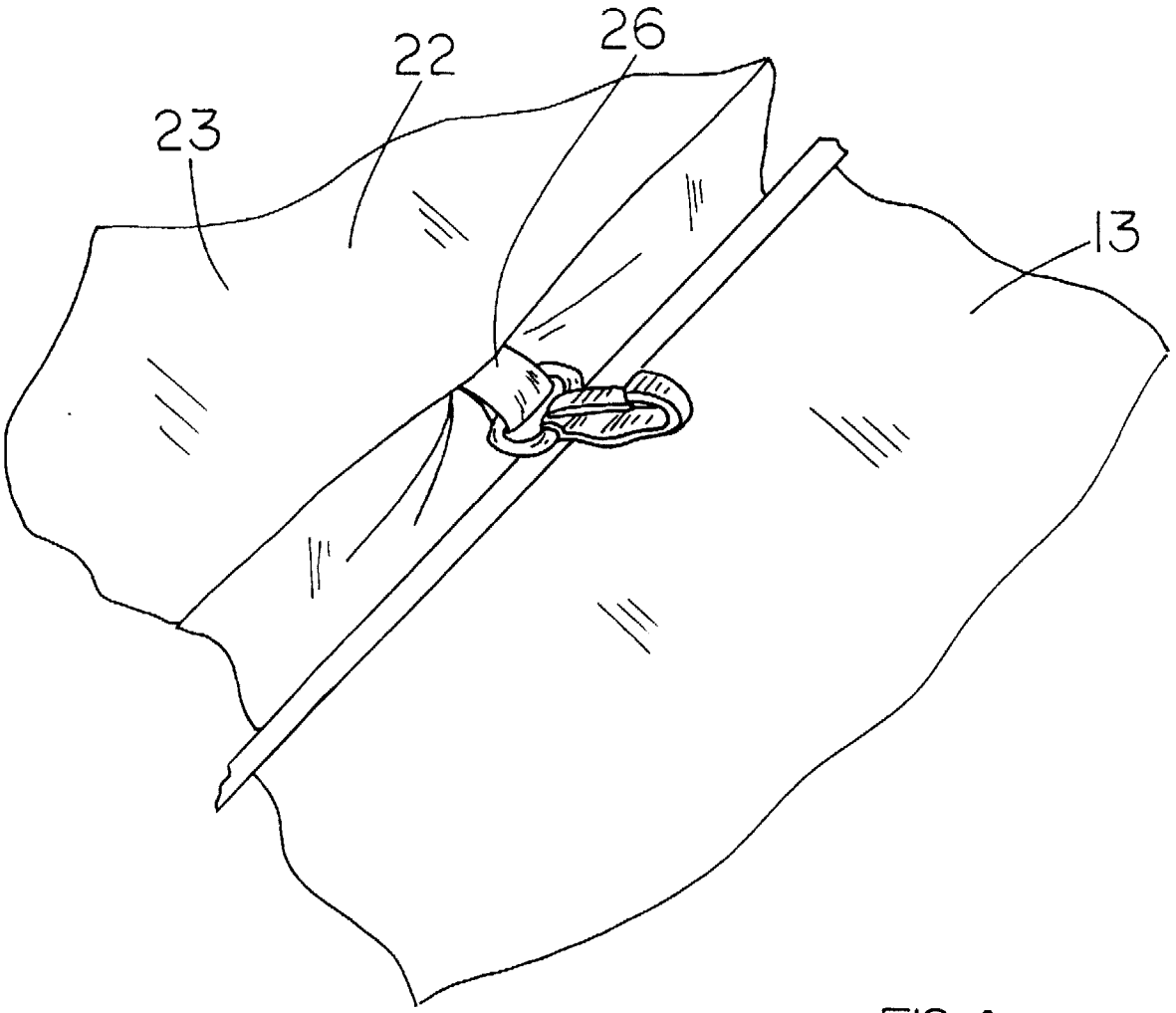
FIG. 4 is an enlarged view of the sofa embodiment of FIG. 2, illustrating the clasp in the pocket.

FIG. 4 shows an enlarged version of the seat of FIG. 2 with the clasp 26 shown engaged to the fabric 23 of the pocket 22 by a fabric loop. Other affixation means may be used.

Figure 5:
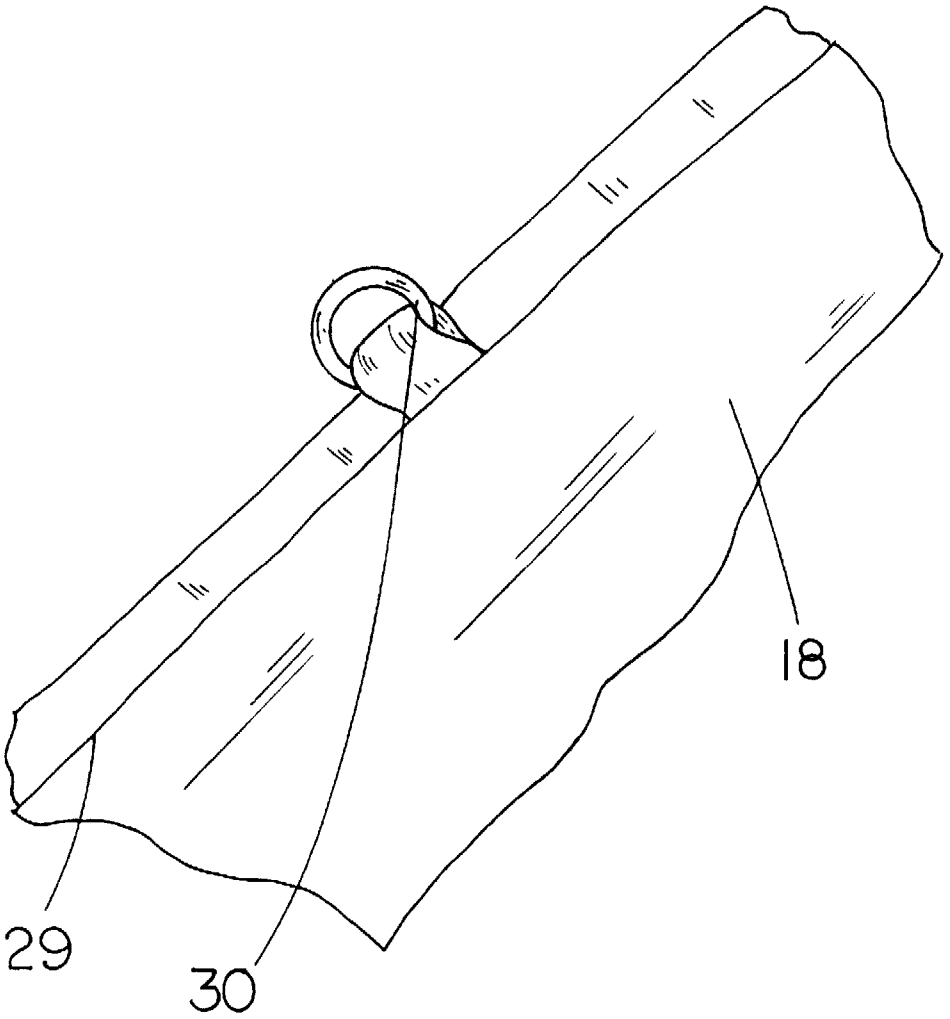
FIG. 5 is an enlarged view of the cushion, illustrating the loop.

As seen in FIG. 5, the loop 30 is attached along the seam 27 of the cushion 18.

The invention has been depicted in a particular embodiment with respect to a sofa, but may be carried out in various other upholstered furniture components. It is presently preferred that the fabric 20, 21 be different, but they could be identical, providing for a second clean surface should a first surface become soiled in normal use.

As seen in the drawing figures, the cushion 18 is symmetrical right-to-left, so that the removal of the sofa and its rotation 180° around a vertical centerline results in the presentation of the backside of the cushion for display as the cushion is reinserted.

The pocket 18 is preferably a forward-facing lower portion of the back, but other pocket positions and orientations may be used.

As will be appreciated, the pocket is formed rather deeply so that the complementary retainers—the snaps and clasps and loops—are obscured when the cushion is in place. The location of the snaps along the top seam and their affixation to the fabric surface 23 tends to "bury" the snap under the top roll 15 of the back. The hook and clasp at the bottom of the cushion 18 allow some free movement out away from the fabric surface 23. The result is that the cushion is slanted toward the back, consistent with a desired configuration for appearance and comfort.

Those of ordinary skill in the art will appreciate that the invention can be carried out in various modifications from the preferred embodiment disclosed herein, and those embodiments are deemed to be encompassed within the scope of the present invention.

What is claimed is:

1. A seat comprising a frame, including a bench and a back padded upholstery on said frame covering said bench and said back with a pocket in said padded upholstery as it covers said back formed as an indentation in a portion of the padded upholstery of said back, a cushion having first and second sides and sized to fit in said pocket in said upholstery to fill said pocket and having first and second differing upholstery fabrics on said first and second sides, respectively, and complementary retainers on said cushion and in said pocket cooperative with one another to retain said cushion in said pocket in a first orientation showing said first upholstery fabric on said cushion and a second orientation showing said second upholstery fabric.

2. A seat as claimed in claim 1 wherein said pocket is in a forward-facing lower portion of said back.

3. A seat as claimed in claim 1 wherein said seat is a sofa.

4. A seat as claimed in claim 1 wherein said complementary retainers include loops and clasps.

5. A seat as claimed in claim 1 wherein said complementary retainers include male and female snap portions.

6. A seat as claimed in claim 1 wherein said padded upholstery includes a particular fabric pattern and said first upholstery fabric is also said particular fabric pattern.

7. A seat as claimed in claim 1 wherein said padded upholstery includes a particular fabric pattern and said second upholstery fabric is different from said particular fabric pattern.

8. A seat as claimed in claim 1 wherein said complementary retainers include loops and clasps for a lower portion of said cushion and male and female snap portions for an upper portion of said cushion.

9. A seat as claimed in claim 1 wherein said cushion is symmetrical about a centerline.

10. A seat comprising a frame, including a bench and a back, padded upholstery including a particular fabric pattern on said frame covering said bench and said back with a pocket in said upholstery in a forward-facing lower portion of said back as it covers said back, a cushion symmetrical about a centerline and having first and second sides and sized to fit in said pocket in said upholstery to fill said pocket and having first and second differing upholstery fabrics on said first and second sides, respectively, and complementary retainers on said cushion and in said pocket cooperative with one another including loops and clasps for a lower portion of said cushion and male and female snap portions for an upper portion of said cushion to retain said cushion in said pocket in a first orientation showing said first upholstery fabric and a second orientation showing said second upholstery fabric, wherein first said upholstery fabric is also said particular fabric pattern and said second upholstery fabric is different from said particular fabric pattern.

11. A method of altering the look of a seat comprising the steps of providing a seat including a bench and a back with padded upholstery covering the bench and the back with a pocket in the padded upholstery as it covers the back formed as an indentation in a portion of the padded upholstery of the back, a cushion having first and second sides and sized to fit in the pocket in the padded upholstery to fill the pocket and having first and second differing upholstery fabrics on the first and second sides, respectively, inserting the cushion in the pocket in a first orientation showing the first upholstery fabric on the cushion, removing the cushion from the pocket and inserting the cushion in the pocket in a second orientation showing the second upholstery fabric.

12. A method as claimed in claim 11 wherein the inserting step includes inserting the cushion in the pocket in a forward-facing lower portion of the back.

13. A method as claimed in claim 11 wherein the inserting steps each include engaging loops and clasps to secure the cushion in the pocket.

14. A method as claimed in claim 11 wherein the inserting steps each include engaging male and female snap portions to secure the cushion in the pocket.

15. A method as claimed in claim 11 wherein one of the inserting steps includes inserting the cushion to expose a fabric on the cushion that is the same as the fabric on the rest of the seat.

16. A method as claimed in claim 11 wherein one of the inserting steps includes inserting the cushion to expose a fabric on the cushion that is different from the fabric on the rest of the seat.

17. A method as claimed in claim 11 wherein the inserting steps each include engaging loops and clasps and engaging male and female snap portions to secure the cushion in the pocket.

18. A method as claimed in claim 11 wherein the second inserting step includes rotating the cushion about a centerline to obtain the second orientation to expose the second fabric.

19. A method of altering the look of a seat comprising the steps of providing a seat including a bench and a back with padded upholstery covering the bench and the back with a pocket in the upholstery as it covers the back, a cushion having first and second sides and sized to fit in the pocket in the upholstery to fill the pocket and having first and second differing upholstery fabrics on the first and second sides, respectively, inserting the cushion in the pocket in a forward-facing lower portion of the back in a first orientation showing the first upholstery fabric on the cushion, removing the cushion from the pocket, inserting the cushion in the pocket a second orientation showing the second upholstery fabric including rotating the cushion about a centerline to obtain the second orientation to expose the second fabric, and holding the cushion in place by engaging loops and clasps and by engaging male and female snap portions wherein one of the inserting steps includes inserting the cushion to expose a fabric on the cushion that is the same as the fabric on the rest of the seat and the other of the inserting steps includes inserting the cushion to expose a fabric on the cushion that is different from the fabric on the rest of the seat.

* * * * *